US010223865B2

(12) United States Patent
Ward et al.

(10) Patent No.: US 10,223,865 B2
(45) Date of Patent: Mar. 5, 2019

(54) SYNCHRONOUS BETTING IN WAGERING GAME SYSTEMS

(71) Applicant: Bally Gaming, Inc., Las Vegas, NV (US)

(72) Inventors: Matthew J. Ward, Northbrook, IL (US); Peter R. Anderson, Glenview, IL (US); Joseph A. Sharpe, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 584 days.

(21) Appl. No.: 14/600,931

(22) Filed: Jan. 20, 2015

(65) Prior Publication Data

US 2015/0206387 A1 Jul. 23, 2015

Related U.S. Application Data

(60) Provisional application No. 61/928,782, filed on Jan. 17, 2014.

(51) Int. Cl.
*G07F 17/32* (2006.01)

(52) U.S. Cl.
CPC ..... *G07F 17/3244* (2013.01); *G07F 17/3213* (2013.01)

(58) Field of Classification Search
CPC ..... G07F 17/3244; G07F 17/3213
See application file for complete search history.

(56) References Cited

U.S. PATENT DOCUMENTS

| | | | |
|---|---|---|---|
| 5,259,613 | A | 11/1993 | Marnell, II |
| 5,342,047 | A | 8/1994 | Heidel et al. |
| 5,412,404 | A | 5/1995 | Candy |
| 5,450,938 | A | 9/1995 | Rademacher |
| 5,605,506 | A | 2/1997 | Hoorn et al. |
| 5,655,961 | A | 8/1997 | Acres et al. |
| 5,680,533 | A | 10/1997 | Yamato et al. |
| 5,919,091 | A | 7/1999 | Bell et al. |
| 5,971,271 | A | 10/1999 | Wynn et al. |
| 6,146,276 | A | 11/2000 | Okuniewics |
| 6,280,328 | B1 | 8/2001 | Holch et al. |
| 6,379,246 | B1 | 4/2002 | Dabrowski |
| 7,025,674 | B2 | 4/2006 | Adams et al. |
| 7,335,106 | B2 | 2/2008 | Johnson |
| 7,749,081 | B1 | 7/2010 | Acres |
| 7,867,095 | B2 | 1/2011 | Mattice et al. |
| 7,905,780 | B2 | 3/2011 | Morrow et al. |

(Continued)

FOREIGN PATENT DOCUMENTS

| | | |
|---|---|---|
| AU | 691335 | 3/1999 |
| WO | 9712315 | 4/1997 |

*Primary Examiner* — Werner G Garner
(74) *Attorney, Agent, or Firm* — Grant A. Dingledine; David J. Bremer

(57) ABSTRACT

A method for presenting wagering games on a wagering game machine is described herein. The method can include detecting, by an add-on gaming system of the wagering game machine, a message indicating occurrence of a first wagering game on the wager game machine. The method can further include initiating, by the add-on gaming system, a second wagering game in parallel with the first wagering game on a display device native to the wagering game machine, where the presenting is in response to the detecting the message.

20 Claims, 10 Drawing Sheets

(56) References Cited

U.S. PATENT DOCUMENTS 7,950,999 B2 5/2011 Morrow et al.
8,029,364 B2 10/2011 Loose et al.
8,083,592 B2 12/2011 Wells
8,088,009 B2 1/2012 Finnimore et al.
8,088,014 B2 1/2012 Wells
8,113,956 B2 2/2012 Finnimore et al.
8,133,102 B2 3/2012 Dabrowski
8,241,119 B2 8/2012 Wells
8,241,123 B2 8/2012 Kelly et al.
8,241,124 B2 8/2012 Kelly et al.
8,282,480 B2 10/2012 Wells et al.
8,317,604 B2 11/2012 Wells
8,323,111 B2 12/2012 Finnimore et al.
8,336,697 B2 12/2012 Wells
8,342,935 B1 1/2013 Morrow et al.
8,348,759 B2 1/2013 Dimichele et al.
8,371,937 B2 2/2013 Wells
8,371,942 B2 2/2013 Finnimore et al.
8,376,837 B2 2/2013 Gagner et al.
8,388,424 B2 3/2013 Dabrowski
8,430,741 B2 4/2013 Agarwal et al.
8,475,273 B2 7/2013 Kelly et al.
8,512,144 B2 8/2013 Johnson
2003/0054881 A1 3/2003 Hedrick et al.
2004/0142739 A1 7/2004 Loose et al.
2005/0020358 A1 1/2005 Cram
2005/0162337 A1 7/2005 Ohashi et al.
2005/0240873 A1 10/2005 Czerwinski et al.
2006/0143085 A1 6/2006 Adams et al.
2007/0105613 A1 5/2007 Adams et al.
2007/0111787 A1 5/2007 Adams et al.
2007/0243925 A1 10/2007 Lemay et al.
2007/0243934 A1 10/2007 Little
2008/0009344 A1 1/2008 Graham et al.
2008/0113802 A1* 5/2008 Johnson ..... G07F 17/3239 463/40
2008/0161107 A1 7/2008 Johnson
2009/0098943 A1 4/2009 Weber et al.
2009/0104954 A1 4/2009 Weber et al.
2009/0117999 A1* 5/2009 Johnson ..... G07F 17/32 463/26
2009/0233705 A1 9/2009 Lemay et al.
2010/0210353 A1 8/2010 Gagner et al.
2011/0009188 A1 1/2011 Adiraju et al.
2011/0195792 A1 8/2011 Wells et al.
2011/0263325 A1 10/2011 Atkinson
2012/0108338 A1 5/2012 Wells et al.
2012/0122560 A1 5/2012 Loose et al.
2013/0072310 A1 3/2013 Wells
2013/0130806 A1 5/2013 Gagner et al.
2014/0080563 A1* 3/2014 Johnson ..... G07F 17/3227 463/13
2014/0121006 A1* 5/2014 Johnson ..... G07F 17/3202 463/25
2015/0072766 A1* 3/2015 Hughes ..... G07F 17/3244 463/25

* cited by examiner

SYNCHRONOUS BETTING IN WAGERING GAME SYSTEMS

RELATED APPLICATIONS

This application claims the priority benefit of U.S. Provisional Application Ser. No. 61/928,782 filed Jan. 17, 2014.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2014, WMS Gaming, Inc.

FIELD

Embodiments of the inventive subject matter relate generally to wagering game systems, and more particularly to wagering game systems including presentation of multiple wagering games concurrently for synchronous betting.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

BRIEF DESCRIPTION OF THE FIGURES

Embodiments of the inventive subject matter are illustrated in the Figures of the accompanying drawings in which.

DESCRIPTION OF THE EMBODIMENTS

Introduction

Figure 1:
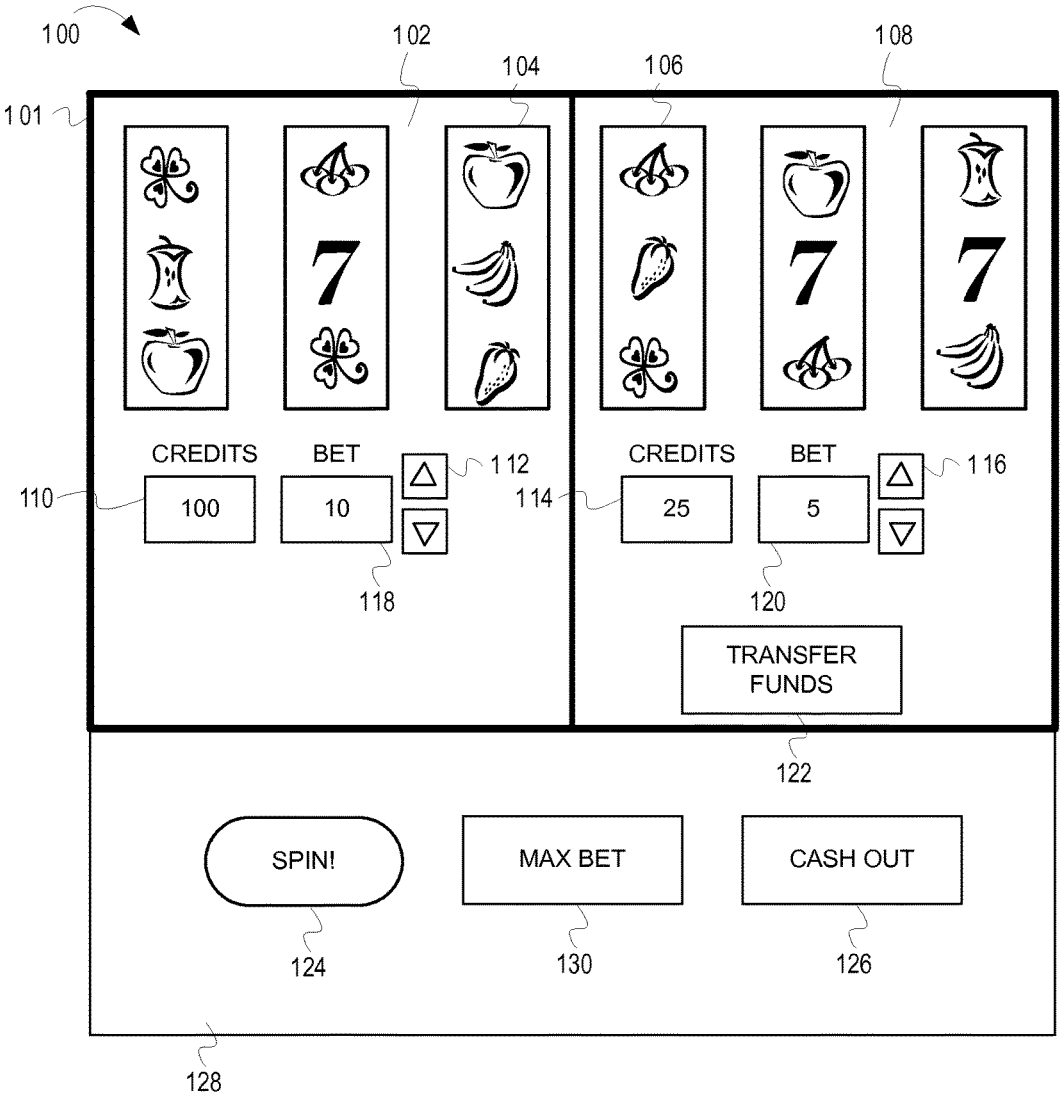
FIG. 1 is a conceptual diagram illustrating how some embodiments can augment a wagering game machine's native wagering game content with secondary gaming content.

This section provides an introduction to some embodiments of the inventive subject matter.

In an effort to increase profits, wagering game machine operators may offer more wagering game content to encourage play and maximize wagering. Embodiments of the inventive subject matter include an add-on gaming system (also referred to as a secondary gaming system) that integrates into a wagering game machine to offer more wagering game content. For example, the add-on gaming system may be installed in a wagering game machine cabinet, along with the machine's standard components. The add-on gaming system may present secondary games for play in parallel with games native to the wagering game machine.

During operation, some embodiments of the add-on gaming system can intercept communications to/from the wagering game machine's primary game controller and other native components of the wagering game machine to facilitate play of wagering games. For example, the add-on gaming system can intercept one or more messages (e.g., one or more Slot Accounting System ("SAS") messages of the SAS protocol available from IGT of Reno, Nev.) generated by a game controller native to the wagering game machine. In response to the message(s), the add-on gaming system can initiate a secondary wagering game on the wagering game machine. In some embodiments, the add-on gaming system receives secondary wagering game content from a remote secondary game server. The add-on gaming system can arrange the secondary wagering game content with native primary wagering game content, where the primary and secondary wagering game content appear simultaneously on a display device of the wagering game machine. As a result, players can play the primary and secondary wagering games in parallel. In some embodiments, a player can play the primary and secondary wagering games contemporaneously using controls native to the wagering game machine, such as by pressing a native spin button. Additionally, in some embodiments, the primary wagering game is associated with a first credit meter and the secondary wagering game is associated with a second credit meter, where the first and second credit meters are independent of one another. With respect to this application, primary wagering game content includes wagering game content native to the wagering game machine and any external components with which the wagering game machine was designed to interact. The primary wagering game content can be used to be present base games (e.g., slots games, card games, etc.) and bonus games (e.g., various games that may award money in addition to the base games). Secondary wagering game content includes wagering game content provided to/by the secondary gaming system. The secondary wagering game content can likewise be used to present base games (e.g., slots games, card games, etc.) and bonus games (e.g., various games that may award money in addition to the base games).

With reference to this application, native components are components that are installed by a manufacturer of the wagering game machine at the time of manufacture of the wagering game machine. Additionally, native components can also include components of the wagering game machine that are replaced and/or updated by the manufacturer of the wagering game machine and installed at a time after manufacture of the wagering game machine. The add-on gaming system can be designed to function with any existing wagering game machine (e.g., a wagering game machine produced by an entity different from the producer of the add-on gaming system) or designed to work with a specific wagering game machine. The add-on gaming system can increase functionality of an existing wagering game machine, increase the variety and/or quantity of content available on the existing wagering game machine, etc. In some embodiments, a player can choose to play only a primary wagering game or only a secondary wagering game on a wagering game machine including the add-on gaming system. Alternatively, the player can play both a primary wagering game and a secondary wagering game on the wagering game machine. When the player is playing only the primary wagering game, the add-on gaming machine can act as a pass-through, intercepting data transmitted by a primary game controller and forwarding the data to other components of the wagering game machine. When the player is playing both a primary wagering game and a secondary wagering game, the add-on gaming system can intercept data from both the primary game controller and secondary game controller, modify the data (e.g., by graphically arranging the wagering game content, scaling the wagering game content, etc.) and transmit the modified data to components of the wagering game machine.

The following discussion of FIG. 1 describes how some embodiments of the add-on system can provide secondary wagering game content along with the wagering game machine's native wagering game content.

FIG. 1 is a conceptual diagram illustrating how some embodiments can augment a wagering game machine's native wagering game content with secondary gaming content. FIG. 1 shows a wagering game machine 100 including a display device 101, button panel 128, and a secondary gaming system (a.k.a. add-on gaming system) (not shown). The display device 101 is presenting multiple wagering games for simultaneous play. The display device 101 includes two display areas: a first display area 102 containing primary wagering game content (native content), and a second display area 108 containing secondary wagering game content (content from the secondary wagering system). The button panel 128 includes a native spin button 124, a max bet button 130, and a cash out button 126. The button panel 128 is native to the wagering game machine.

As noted, the wagering game machine 100 includes a secondary gaming system that presents additional secondary games that are not native to the machine. In FIG. 1, the primary and secondary wagering games are slots-type wagering games. The primary wagering game content includes primary slot reels 104, a primary credit meter 110, a primary bet indicator 118, and primary controls 112 to increase and decrease a bet amount for the primary wagering game. The secondary wagering game content (non-native) includes secondary slot reels 106, a secondary credit meter 114, a secondary bet indicator 120, secondary controls 116 to increase and decrease a bet amount for the secondary wagering game, and a transfer funds button 122.

The transfer funds button 122 allows the player to transfer funds between the primary credit meter 110 and the secondary credit meter 114. The native spin button 124 allows players to spin the reels of the primary wagering game and the secondary wagering game in parallel (e.g., the games may be played contemporaneously). After a player presses the spin button 124, the wagering game machine transmits one or more messages indicating that a wager has been placed and that a wagering game should commence. The secondary gaming system can detect, intercept, or otherwise receive such messages. In response to these messages, the secondary gaming system can present an additional wagering game along with the native game. For example, in FIG. 1, the secondary gaming system moves the primary slots game into display area 102, and contemporaneously presents the secondary slots game in display area 108. In some embodiments, the secondary gaming system can vary presentation of the primary and secondary games. For example, the slot reels may begin spinning at the same time, stop spinning at the same time, spin sequentially (e.g., the primary slot reels 104 spin and the then secondary slot reels 106 spin, or vice versa), spin during overlapping time periods (e.g., the primary slot reels 104 and secondary slot reels 106 can begin and stop spinning at different times, but they both spin simultaneously for some duration), etc. Additionally, results for the primary wagering game and the secondary wagering game can be presented in any suitable manner or sequence. For example, results for both wagering games can be presented at the same time, sequentially, etc.

The cash out button 126 allows the player to remove any remaining credits from the wagering game machine in the form of cash, a ticket indicating a monetary value, an electronic funds transfer, etc. Instead of mechanical buttons, in some embodiments, a spin button, max bet button, cash out button, etc. are presented on the display device 101 as soft buttons. In such embodiments, the player can use the soft spin button to initiate play of the primary and secondary wagering game content in parallel. In some embodiments, the primary wagering game and the secondary wagering game can include independent controls, such as independent spin buttons on the display device 101. In such embodiments, players may not use the native spin button 124 to initiate play.

As mentioned, the secondary gaming system (not shown) can arrange the primary and secondary wagering game contents to appear together on the display device 101. For example, the secondary gaming system can resize the primary and secondary wagering game contents, and associate the primary wagering game content with the first display area 102 and the secondary wagering game content with the second display area 108. As a result, the primary and secondary wagering game contents can be presented in parallel and the games can be played in parallel.

In some embodiments, the secondary gaming system scales up/down (i.e., make larger/smaller) the secondary wagering game content, the primary wagering game content, or both. In embodiments that scale-down the primary wagering game content, the secondary gaming system can determine new touch screen input locations for the scaled-down primary wagering game content. After being scaled-down, the primary wagering game content will not occupy the entirety of the display device 101, thereby making room for secondary wagering game content. If the primary wagering game content includes soft buttons (e.g., soft buttons on a touch screen), locations of the soft buttons will change because of the scaling-down process. The secondary gaming system can create a mapping relationship between the location of soft buttons (and other wagering game elements) in the scaled-down wagering game content and the original primary and secondary contents. The mapping relationship is useful because the native components are not aware of the scaling process, so inputs for the scaled content may not be meaningful to native components. For example, in the original primary content, a soft button may occupy an area at location X. Therefore, for the original content, touchscreen inputs in the area at location X indicate that a player has pressed the soft button. When the secondary wagering game system modifies (e.g., scales-down) the primary content, it may move the soft button from location X to a second location (location Y). If the secondary system reports to the primary game controller an input at location Y, the primary controller will not interpret the input as being a press of the soft button. However, after the secondary gaming controller maps input at location Y back to location X, the primary game controller will interpret the input as a soft button press, thereby enabling the primary game controller to remain unaware of the secondary gaming system.

Figure 2:
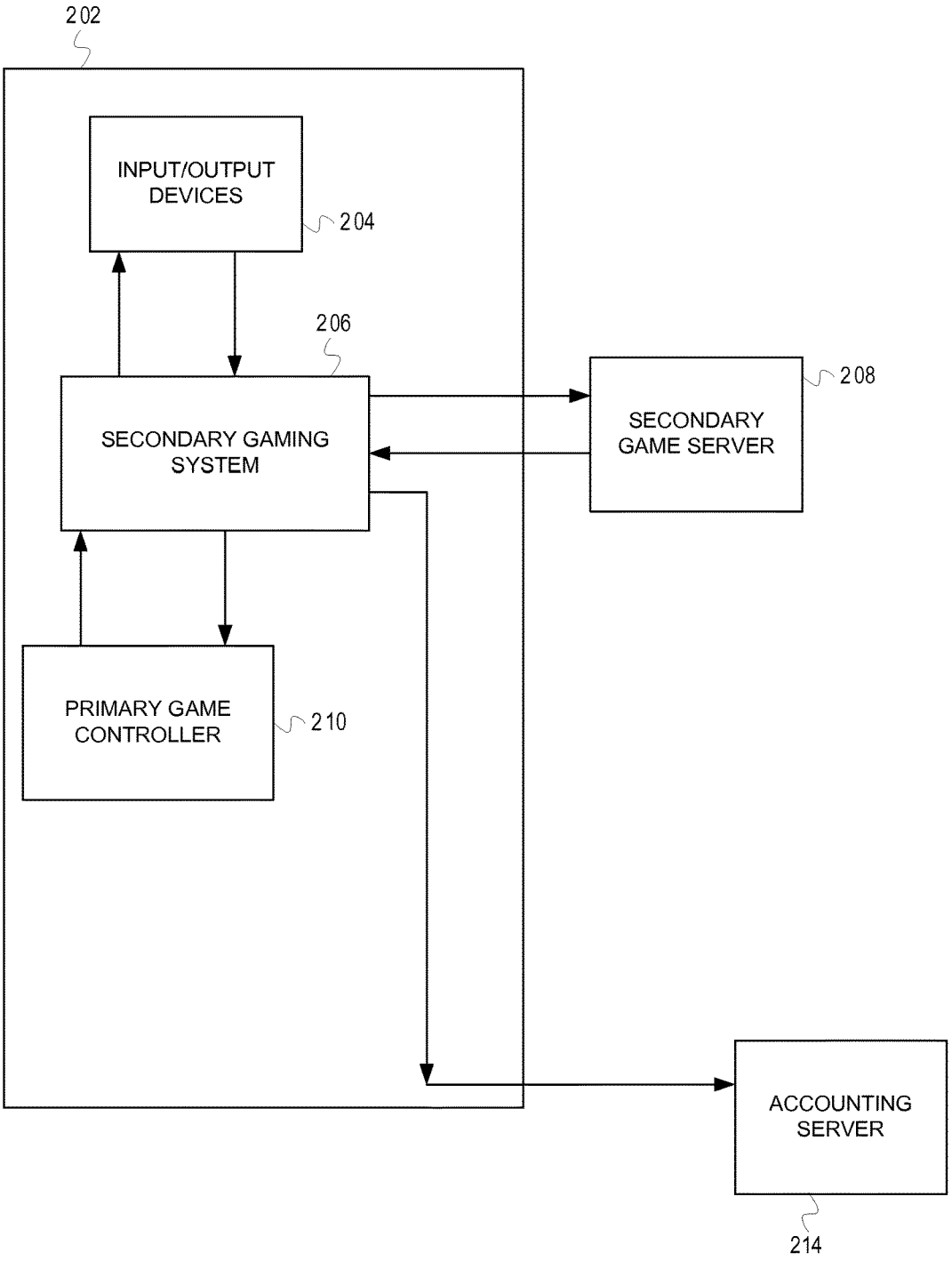
FIG. 2 is block diagram of an example wagering game system including a wagering game machine 202 having a secondary gaming system 206 for arranging wagering game content.
Figure 3:
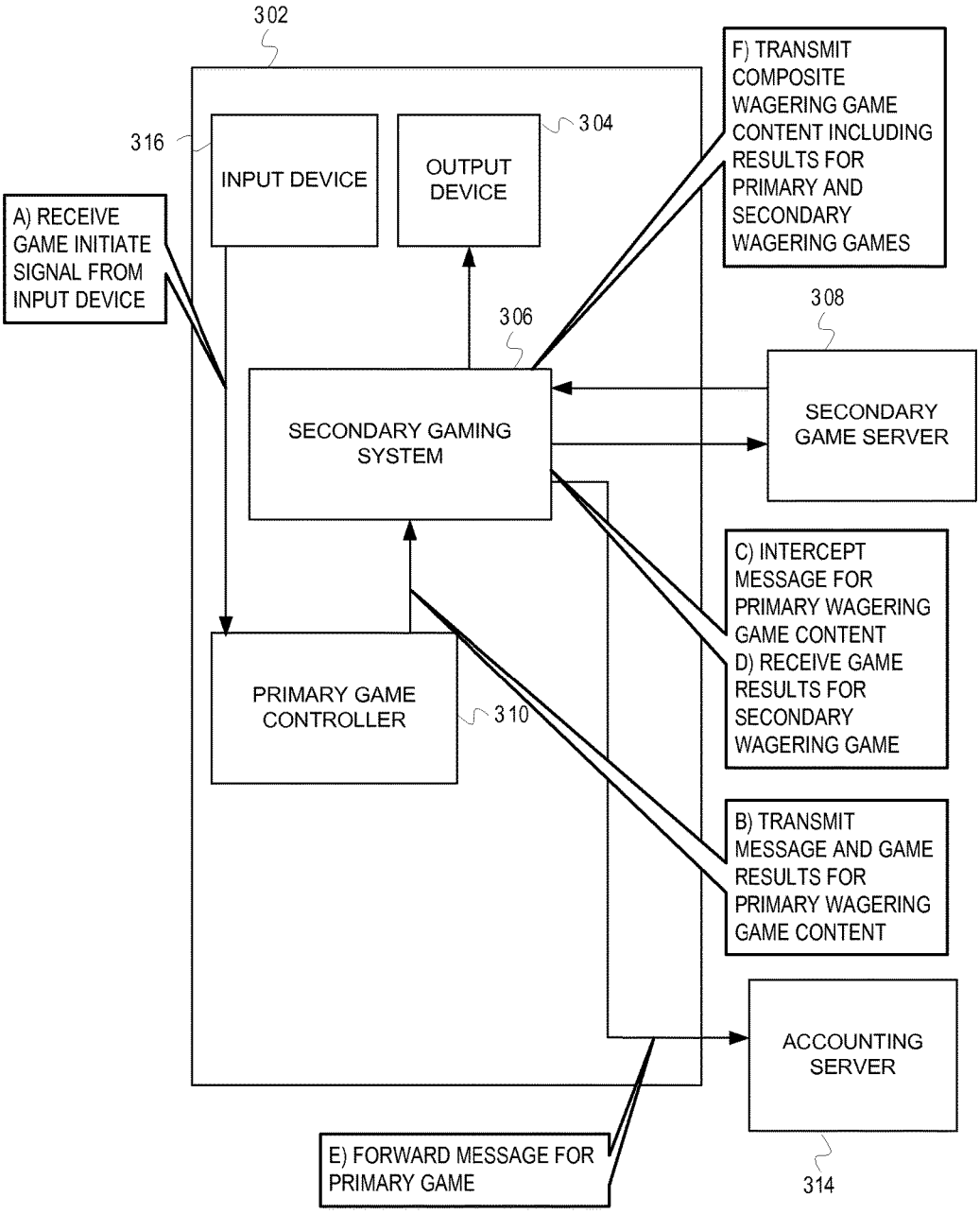
FIG. 3 is a block diagram of an example wagering game system including example operations for processing a message prompting play of a secondary wagering game.

This discussion will continue by describing various configurations of the secondary gaming system. Different embodiments of the secondary gaming system can interact with native machine components in different ways. In some embodiments, the secondary gaming system intercepts (or otherwise receives) all inputs from native input/output devices. FIG. 2 (discussed below) shows such an embodiment. In other embodiments, the secondary gaming system does not intercept (or otherwise receive) communications from native input devices, such as buttons on the panel 128. In such an embodiment, inputs go to the wagering game machine's primary game controller, and the secondary system intercepts (or otherwise receives) communications going to/from the primary game controller. FIG. 3 (discussed below) shows such an embodiment. In yet other embodiments, the secondary wagering game system intercepts some inputs (e.g., touchscreen inputs), but not others (e.g., native button inputs). The discussion continues with the embodiment shown in FIG. 2.

FIG. 2 is block diagram of an example wagering game system including a wagering game machine 202 having a secondary gaming system 206. The secondary gaming system 206 can intercept (or otherwise receive) messages from components of the wagering game machine 202, such as native buttons, a touch screen, etc. Additionally, the secondary gaming system 206 can arrange (e.g., resize, relocate, etc.) wagering game content, as described below. The wagering game machine 202 includes input/output devices 204 (e.g., a touchscreen, a display device, hard buttons, etc.) and a primary game controller 210. The primary game controller 210 includes a central processing unit (CPU), memory, and any other peripheral components suitable for providing wagering game content. The primary game controller 210 provides primary wagering game content for the wagering game machine 202. In some embodiments, the primary game controller 210 includes a wagering game unit operable to calculate wagering game results included in the primary wagering game content. In other embodiments, the primary game controller 210 includes a wagering game unit operable to relay input for the primary wagering game content and receive results for the primary wagering game content from a wagering game server (not shown).

The wagering game machine 202 also includes a secondary gaming system 206. In some embodiments, the secondary gaming system 206 includes components similar to that of the primary game controller 210 (e.g., a CPU, memory, etc.). The secondary gaming system 206 can provide content that is not native to the wagering game machine 202, such as additional games, internet content, streaming game results, etc. As noted in the discussion of FIG. 1, the secondary gaming system 206 can present a secondary game in addition to the wagering game machine's 202 native primary game. The secondary gaming system 206 can detect initiation of a native game by intercepting certain messages (e.g., certain SAS protocol messages) from the primary game controller 210. After detecting initiation of a native game, the secondary gaming system 206 can initiate and present a secondary game in parallel with the primary game (e.g., see FIG. 1). To present the secondary game, the secondary gaming system 206 can request and receive secondary wagering game content from a secondary game server 208. The secondary wagering game content can include game results determined by the secondary game server 208. The secondary gaming system 206 can arrange (e.g., resize, relocate, etc.) the primary wagering game content received from the primary game controller 210 and the secondary wagering game content received from the secondary game server 208 to create composite wagering game content. The composite wagering game content includes the primary wagering game content and the secondary wagering game content, so that both the primary wagering game content and the secondary wagering game content are playable in parallel by a player via the input/output device 204. In some embodiments, a player can relocate wagering game content within the composite wagering game content (e.g., swap the location of the primary wagering game content and the secondary wagering game content), change the size of the primary or secondary wagering game content within the composite wagering game content, etc. In some embodiments, the secondary gaming system 206 reports transactions, results, winnings, losses, transfers between a primary credit meter and secondary credit meter, etc. to an accounting server 214 (e.g., using the SAS protocol).

This discussion continues with a description of an alternative secondary gaming system configuration, and operations performed by such a configuration.

FIG. 3 is a block diagram of an example wagering game system including example operations for processing a message prompting play of a secondary wagering game. The example wagering game system includes a wagering game machine 302, secondary game server 308, and accounting server 314. The wagering game machine 302 includes an input device 316, an output device 304, secondary gaming system 306, and primary game controller 310. In FIG. 3, the secondary gaming system 306 does not intercept (or otherwise receive) input from native devices (e.g., native buttons on a button panel). Instead, the secondary gaming system 306 "listens to" (or otherwise receives) communications from the primary game controller 310.

FIG. 3 depicts example operations illustrating how the secondary gaming system 306 presents additional content in parallel with native content. The operations proceed in stages A-F. The stages are example and are not necessarily discrete occurrences over time (e.g., the operations of different stages may overlap).

At stage A, the primary game controller 310 receives a game initiate signal from the input device 316. The game initiate signal, for example, can be a button press of a native mechanical button (e.g., a spin button on a button panel).

At stage B, the primary game controller 310 transmits a message and game results for a primary wagering game. The primary game controller 310 generates and transmits the message and game results for the primary wagering game in response to the game initiate signal. The message can explicitly or implicitly trigger play of a secondary wagering game using content that is not native to the wagering game machine 302. For example, the message can be an accounting message indicating that a round of the primary wagering game has been played (e.g., an accounting message, such as a SAS protocol message). In some embodiments, the message can include an indication to the secondary gaming system 306 to initiate play of the secondary wagering game. In some embodiments, the primary game controller 310 determines game results for the primary wagering game. In other embodiments, the primary game controller 306 can request game results for the primary wagering game from a component external to the wagering game machine 302 (e.g., a wagering game server).

At stage C, the secondary gaming system 306 intercepts the message and game results transmitted by the primary game controller 310. In response to the message transmitted by the primary game controller 310, the secondary gaming system 306 requests game results for a secondary wagering game from the secondary game server 308. In other words, receipt of the primary game controller's 310 message triggers play of the secondary wagering game.

At stage D, the secondary gaming system 306 requests and receives game results for the secondary wagering game from the secondary game server 308. As noted, the secondary wagering game is based on wagering game content that is not native to the wagering game machine 302. Also during stage D, the secondary gaming system 306 can arrange primary wagering game content and secondary wagering game content (e.g., game results for the primary and secondary wagering games) to form composite wagering game content, as described in more detail below.

At stage E, the secondary gaming system 306 forwards the message received from the primary wagering game to the accounting server 314. That is, after intercepting the message, the secondary gaming system 306 passes the message along to its intended destination. The message can include accounting information and conform to any of a number of protocols (e.g., the SAS protocol, the G2S protocol available from the Gaming Standards Association, etc.).

At stage F, the secondary gaming system 306 transmits the composite wagering game content to the output device 304 for presentation on the output device 304.

This discussion continues with a description of another configuration of the secondary gaming system. In this configuration, the secondary gaming system intercepts all inputs in the wagering game machine, including touchscreen inputs. As described above, the secondary gaming system can resize and relocate primary wagering game content to make room for secondary content. Because the secondary gaming system can intercept touchscreen input, it can translate touchscreen inputs made on the resized content into inputs for the original content. The secondary gaming system can deliver the translated touchscreen input to the primary game controller. As a result, the secondary gaming system adds secondary content and modifies (scales and relocates) the primary content without the primary game controller "realizing" anything has changed.

Figure 4:
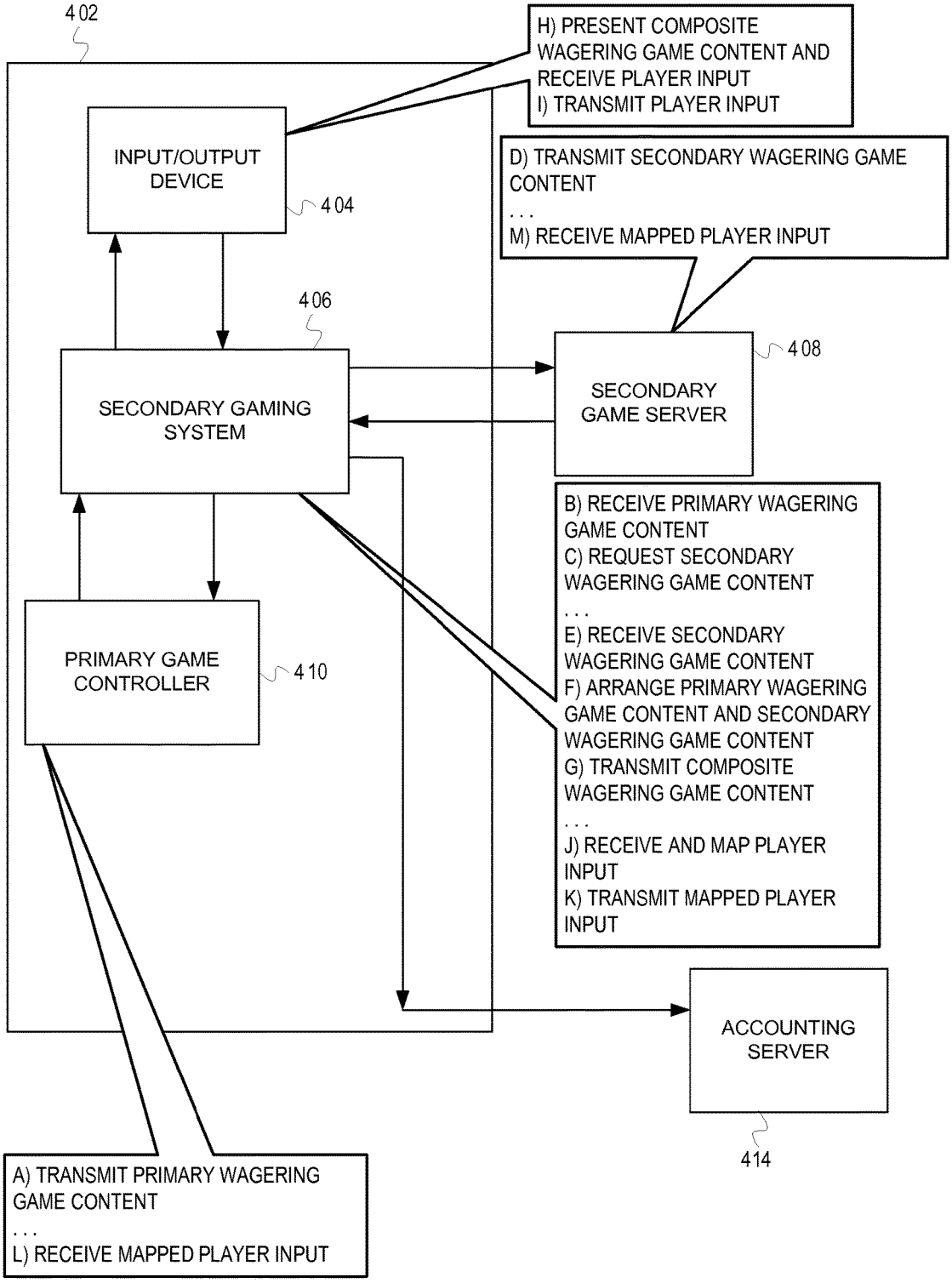
FIG. 4 is a block diagram of an example wagering game system including example operations for arranging wagering game content for synchronous play.

FIG. 4 is a block diagram of an example wagering game system including example operations for arranging wagering game content for parallel play. The example wagering game system includes a wagering game machine 402 including input/output device 404 and primary game controller 410, a secondary gaming system 406, secondary game server 408, and an accounting server 414. FIG. 4 depicts example operations at stages A-L. The operations begin after a primary game has been initiated, and progress to show how embodiments translate touchscreen inputs (also referred to as mapping touchscreen inputs). The stages are examples and are not necessarily discrete occurrences over time (e.g., the operations of different stages may overlap).

At stage A, the primary game controller 410 transmits primary wagering game content to the secondary gaming system 406. This transmission may be in response to a player requesting to play both primary and secondary wagering games in parallel (see FIG. 1). The secondary gaming system 406 can receive the player's request to play (in parallel) primary and secondary games, and relay a request for primary wagering game content to the primary game controller 410. In response to the request for primary wagering game content, the primary game controller 410 transmits primary wagering game content to the secondary wagering game controller 408 (shown as stage A).

At stage B, the secondary gaming system 406 receives the primary wagering game content from the primary game controller 410.

At stage C, the secondary gaming system 406 requests secondary wagering game content from the secondary game server 408 (e.g., for use in presenting the primary and secondary wagering games in parallel). In some embodiments, the secondary gaming system 406 can locally store secondary game content, and therefore skip stages C-E.

At stage D, the secondary wagering game server 408 transmits the secondary wagering game content to the secondary gaming system 406.

At stage E, the secondary gaming system 406 receives the secondary wagering game content from the secondary game server 408.

At stage F, the secondary gaming system 406 arranges the primary wagering game content and the secondary wagering game content to form composite wagering game content. The composite wagering game content comprises the primary wagering game content and the secondary wagering game content. When the secondary gaming system 406 arranges the primary wagering game content and the secondary wagering game content, the secondary gaming system 406 scales the primary wagering game content (and the secondary wagering game content, if necessary), and associates the primary wagering game content with a first display area (e.g., on the input/output device 404) and the secondary wagering game content with a second display area (e.g., on the input/output device 404). Referring to FIG. 1, in some embodiments, the secondary gaming system 406 associates the primary wagering game content with the first display area 102, and scales the primary content to fit in the first display area 102. The secondary gaming system 406 may perform similar operations for the secondary wagering game content.

At stage G, secondary gaming system 406 transmits the composite wagering game content to the input/output device 404 for presentation. The input/output device 404 can include one or more touchscreens, one or more display devices and one or more input devices (e.g., hard buttons, joysticks, levers, etc.), etc.

At stage H, the input/output device 404 presents the composite wagering game content and receives player input for the composite wagering game content. For example, the input/output device can present the composite wagering game content on a video display device outfitted with an overlaid touchscreen. The presentation of the composite wagering game content includes presentation of the primary and secondary wagering game contents in the form of the primary and secondary wagering games (e.g., see FIG. 1). The input/output device 404 can receive player input associated with the composite wagering game content. For example, the player input can be touchscreen input for playing the primary and/or secondary wagering game.

At stage I, the input/output device 404 (e.g., touchscreen) transmits the player input for the composite wagering game content to the secondary gaming system 406.

At stage J, the secondary gaming system 406 receives and maps the player input. Referring to FIG. 1 for example, consider player input to increase the bet for the primary wagering game via primary controls 112. The secondary gaming system 406 maps the player input for the composite wagering game content to the original primary wagering game content. The secondary gaming system 406 maps the player input because the primary wagering game content has been resized to occupy only a portion of the input/output device 404 (see stage F). For example, in FIG. 1, the primary controls 112 are presented on the left half of the input/output device 404 when presented as part of the composite wagering content. If the primary wagering game content were not modified (i.e., occupying the entire input/output device 404), the primary controls 112 would appear on the right half of the input/output device. In some embodiments, the mapping is performed via mathematical transformation. For example, before the primary wagering game content is modified to form the composite wagering game content, a rectangular wagering game element's four corners reside at the coordinates (20, 20), (80, 20), (80, 60), and (20, 60), in an X-Y coordinate plane. When the primary wagering game content is modified (i.e., scaled) to be half as large, the location of the four corners of the rectangular wagering game element change. Assuming that the only modification to the primary wagering game content is the decrease in size, the rectangular wagering game element's four corners now reside at the coordinates (10, 10), (40, 10), (40, 30), and (10, 30) of the composite wagering game content. The primary wagering game content can also be modified by moving the primary wagering game content to a different area of the display device when the primary wagering game content is arranged to form the composite wagering game content. In such embodiments, the mathematical transformation also requires translation of the coordinates. For example, if the primary wagering game content is reduced in size by half and moved by 500 pixels to the right, the rectangular wagering game element's four corners would now reside at (510, 10), (540, 10), (540, 30), and (510, 30). In embodiments where the mapping is performed via mathematical transformation, the secondary gaming system 406 applies a mathematical formula to the user input to map the user input from the composite wagering game content to the primary wagering game content. In the example described above, screen input includes coordinates indicating a location of the input (e.g., (X, Y)). To map the user input from the composite wagering game content to the primary wagering game content, the secondary gaming system 406 can subtract 500 from the X value of each coordinate, then multiply both the X value and Y value of each coordinate by two. After the translation, the input is now in a form that is meaningful to the primary game controller.

At stage K, the secondary gaming system 406 transmits the mapped player input to the primary game controller 410. In some instances, this stage may not be necessary. For example, if the player input is not associated with the primary wagering game content, the secondary gaming system 406 may not transmit the mapped player input to the primary game controller 410.

At stage L, the primary game controller 410 receives the mapped player input. Because the input has been mapped back to the layout of the original primary content, the input is meaningful to the primary game controller 410. The primary game controller 410 can perform operations based on the mapped input, such as transferring funds, increasing a bet, etc. As similarly noted above, this stage may not be necessary. For example, if the player input is not associated with the primary wagering game content, the secondary gaming system 406 may not transmit the mapped player input to the primary game controller 410. If the mapped player input corresponds only to the secondary wagering game content, the secondary gaming system 406 will transmit the player input to the secondary game server 408.

In some embodiments, if the player input is input to play a round of the primary wagering game and a round of the secondary wagering game, the secondary gaming system 406 and/or the primary game controller 410 first assesses the balance of the primary credit meter and the secondary credit meter. If both the primary credit meter and the secondary credit meter contain funds sufficient to play the primary and secondary wagering games, the primary and secondary wagering game are played. If one or both of the credit meters do not contain sufficient funds, one or both of the games may not play. For example, if only the secondary credit meter contains funds sufficient to play a wagering game, the secondary gaming system 406 can incorporate a button in the composite wagering game content that only initiates play of the secondary wagering game. In some embodiments, a round of the secondary wagering game will only play if the primary credit meter contains funds sufficient to play a round of the primary wagering game. In other words, in some embodiments, the round of the secondary wagering game will not play if the primary credit meter does contains funds sufficient to play a round of the primary wagering game. In such embodiments, the wagering game machine can prompt the player to insert funds into the wagering game machine for the primary wagering game or transfer funds to the primary wagering game credit meter.

Figure 5:
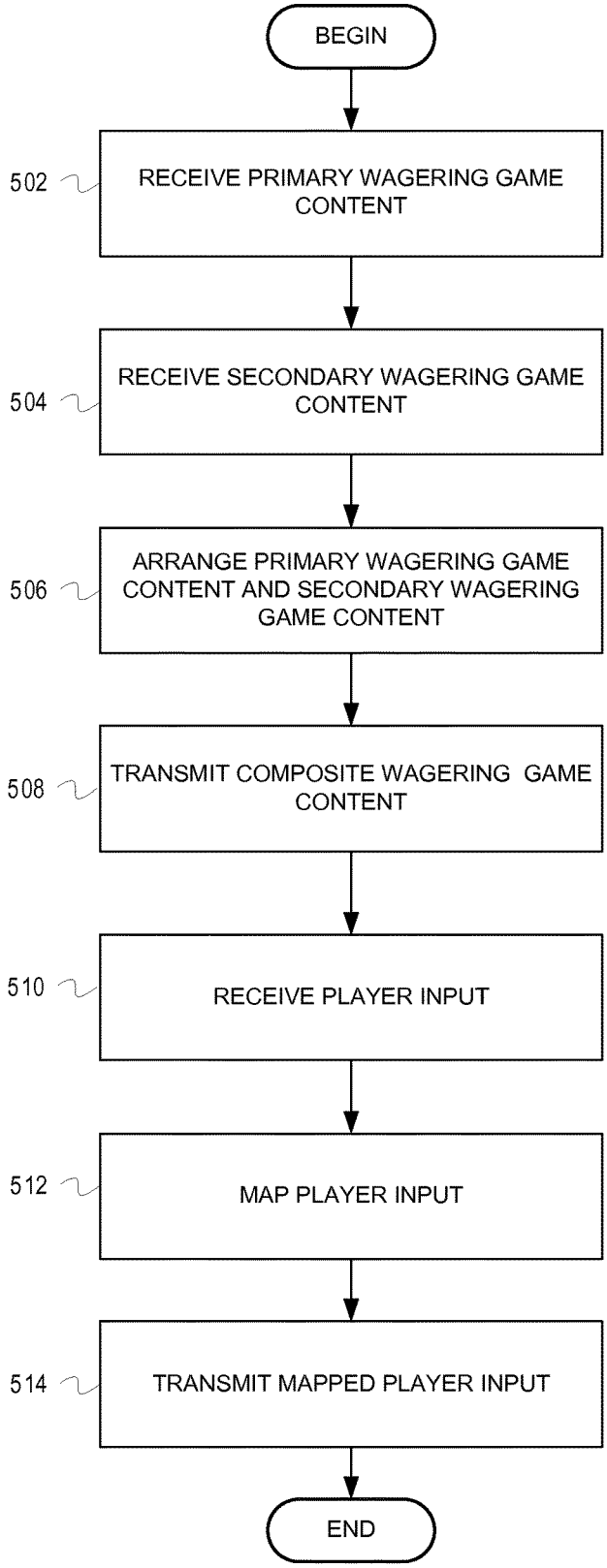
FIG. 5 flow diagram illustrating example operations for arranging wagering game content for synchronous play.

FIG. 5 flow diagram illustrating example operations for arranging wagering game content for synchronous play. The flow begins after a primary game has been initiates, and progress to show how embodiments translate touchscreen inputs (also referred to a mapping touchscreen inputs). The flow begins at block 502.

At block 502, the secondary gaming system receives primary wagering game content from the primary game controller. The flow continues at block 504.

At block 504, the secondary gaming system receives secondary wagering game content from the secondary game server. The flow continues at block 506.

At block 506, the secondary gaming system arranges the primary wagering game content and the secondary wagering game content to form composite wagering game content. In some embodiments, the secondary gaming system arranges the primary wagering game content and the secondary wagering game content by associating a first display area of a display device with the primary wagering game content and a second display area of the display device with the secondary wagering game content. Additionally, the secondary gaming system can scale the primary wagering game content and/or the secondary wagering game content (see discussion of FIG. 4). The secondary gaming system can arrange the primary wagering game content and the secondary wagering game content using any suitable computer graphics technology (e.g., picture-in-picture, split screen, etc.). The flow continues at block 508.

At block 508, the secondary gaming system transmits the composite wagering game content for presentation on the display device of the wagering game machine. The presentation of the composite wagering game content comprises the primary wagering game content, the secondary wagering game content, and any information and/or controls for the primary wagering game content and the secondary wagering game content. The flow continues at block 510.

At block 510, the secondary gaming system receives player input for the composite wagering game content. The player input can be received via any suitable input mechanism associated with the wagering game machine. For example, the player input can be touchscreen input, a button press, a lever pull, etc. The flow continues at block 512.

At block 512, the secondary gaming system maps the player input. The secondary gaming system maps the player input because the primary wagering game content, and in some embodiments, the secondary wagering game content, has been scaled to fit into one of the first and second areas of the display device. Because the wagering game content has been scaled, the location of soft buttons associated with the wagering game content may no longer be in the same location. For example, if the primary wagering game content is scaled from a full screen version to a version that occupies only half of the display device, the location of the soft buttons is changed when the secondary gaming system arranges the primary wagering game content and the secondary wagering game content. The secondary gaming system translates the player input associated with the composite wagering game content to correspond to the full screen version of the primary wagering game content. The flow continues at block 514.

At block 514, the secondary gaming system transmits the mapped player input. In some embodiments, mapped player input is only transmitted to the source associated with the wagering game content corresponding to the player input. For example, if the player input is to increase a bet amount for the primary wagering game, the secondary gaming system transmits the mapped player input only to the primary game controller.

Figure 6:
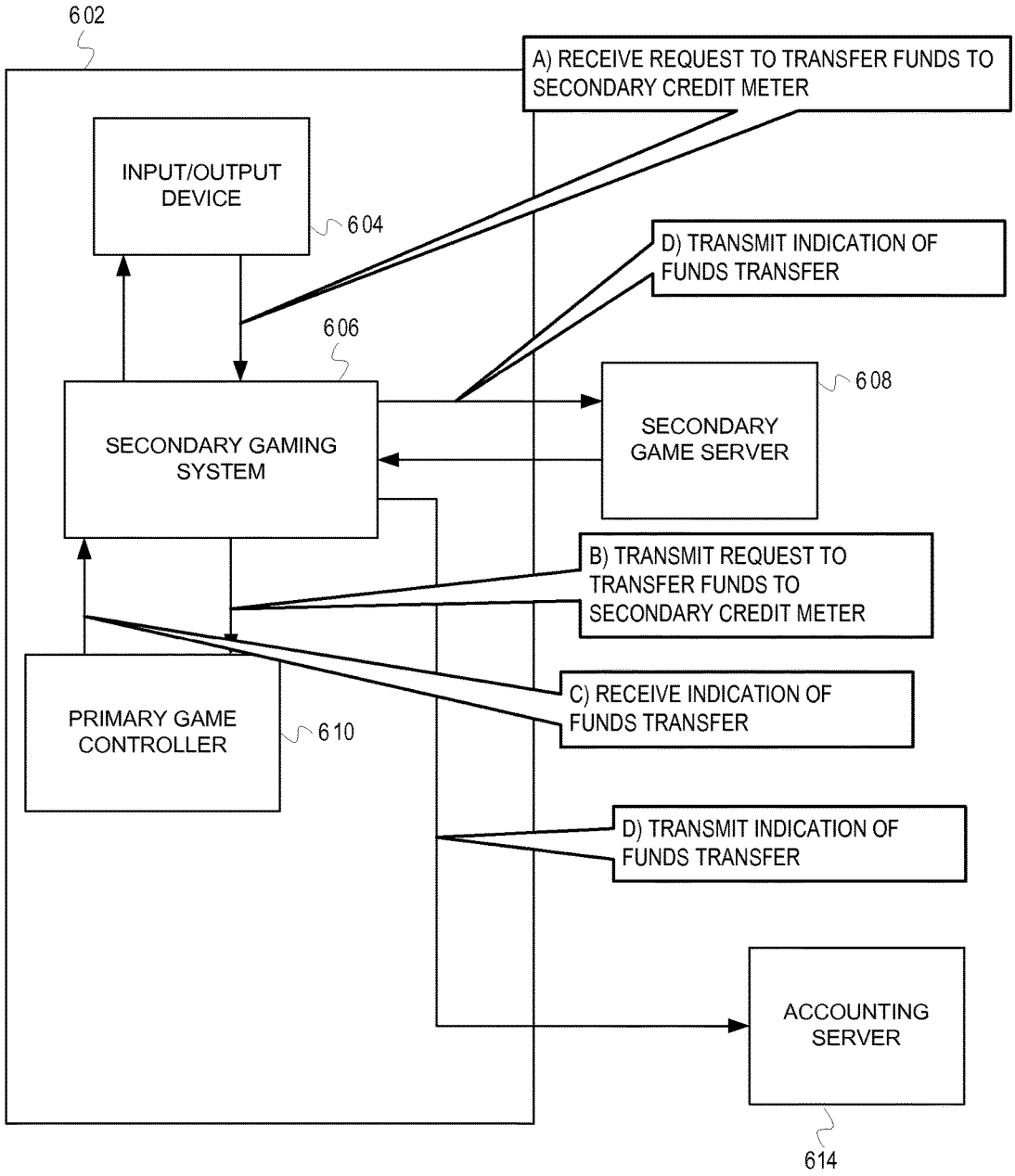
FIG. 6 is a block diagram of an example wagering game system including example operations for funding a credit meter associated with a secondary wagering game.
Figure 7:
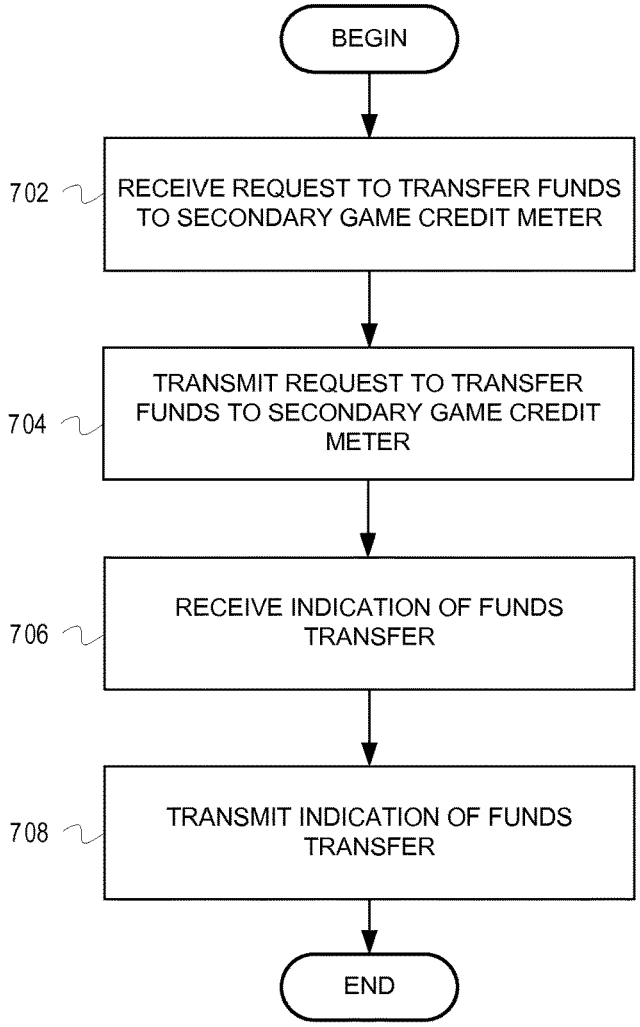
FIG. 7 is a flow diagram illustrating example operations for funding a credit meter associated with a secondary wagering game.

While FIGS. 4 and 5 describe example operations for parallel play of wagering games via the example wagering game system, FIGS. 6 and 7 describe example operations for funding a secondary credit meter.

FIG. 6 is a block diagram of an example wagering game system including example operations for funding a credit meter associated with a secondary wagering game. In practice, some of the operations may require the above-described mapping. However, for clarity, the discussion of FIG. 6 omits any discussion of mapping. In FIG. 6, the example wagering game system includes a wagering game machine 602 including input/output device 604, and a primary game controller 610, a secondary gaming system 606 secondary game server 608, and an accounting server 614. FIG. 6 depicts example operations at stages A-D. The stages are examples and are not necessarily discrete occurrences over time (e.g., the operations of different stages may overlap).

At stage A, the secondary gaming system 606 receives a request to transfer funds to a secondary credit meter associated with secondary wagering game content. In some embodiments, a player initiates a wagering game session at the wagering game machine 602 by inserting or loading money, a ticket, or some other form of value into the wagering game machine 602. The monetary value inserted or loaded into the wagering game machine 602 is credited toward a primary credit meter associated with primary wagering game content. The player can then transfer funds from the primary credit meter to the secondary credit meter. For example, the player can insert a twenty dollar bill into a value input device of the wagering game machine 602. Twenty dollars is then credited to the primary credit meter. The player can then choose to transfer funds from the primary credit meter to the secondary credit meter. For example, the player can transfer ten dollars from the primary credit meter to the secondary credit meter, resulting in a ten dollar balance on the primary credit meter and a ten dollar balance on the secondary credit meter. Referring to FIG. 1, the player can select the transfer funds button 122 presented on the display device 100. In some embodiments, upon selection of the transfer funds button 122, the wagering game machine will present a menu containing options from which the player can select. For example, the menu can include options to transfer funds from the primary credit meter to the secondary credit meter, transfer funds from the secondary credit meter to the primary credit meter, to select an amount to transfer, etc.

At stage B, using for example a SAS funds transfer protocol message, the secondary gaming system 606 transmits to the primary game controller the request to transfer funds to the secondary credit meter. If the primary credit meter contains funds sufficient to fulfill the request, the primary game controller can facilitate the transfer of funds from the primary credit meter to the secondary credit meter. If the primary credit meter does not contain funds sufficient to fulfill the request, the primary game controller can deny the request.

At stage C, the secondary gaming system 606 receives an indication of a funds transfer in response to transmitting the request to transfer funds to the secondary credit meter. In some embodiments, the indication of the funds transfer can be a confirmation of an electronic funds transfer, information facilitating an electronic funds transfer, etc.

At stage D, the secondary gaming system 606 transmits the indication of the funds transfer to the secondary game server 608. In some embodiments, the secondary gaming system 606 also transmits the indication of the funds transfer to the accounting server 614 for record-keeping purposes. In other embodiments, components other than the secondary gaming system 606 can transmit the indication of the funds transfer to the account server 614 (e.g., the primary controller). Additionally, although not depicted in FIG. 6, operations similar to those in FIG. 6 can be used to transfer funds from the secondary credit meter to the primary credit meter. In some embodiments, when the player chooses to cash out, all funds remaining on the secondary credit meter are transferred to the primary credit meter before the player cashes out. Although examples refer to the secondary gaming system 606 transmitting the indication of funds transfer to the accounting server 614, in some embodiments, the secondary gaming system 606 does not initiate this transmission. In such embodiments, the accounting sever 614 periodically polls an accounting meter associated with the primary game controller 610 and an accounting meter associated with the secondary gaming system 606 to collect information about the funds transfer.

FIG. 7 is a flow diagram illustrating example operations for funding a credit meter associated with a secondary wagering game. The flow begins at block 702.

At block 702, the secondary gaming system receives a request to transfer funds to the secondary credit meter. In some embodiments, funds must first be credited to the primary credit meter and then funds are transferred from the primary credit meter to the secondary credit meter. In other embodiments, a player can instruct the secondary gaming system via the wagering game machine to credit funds to the secondary credit meter before inserting or loading the funds into the wagering game machine. In such embodiments, the operations at block 704 may be unnecessary. The flow continues at block 704.

At block 704, the secondary gaming system transmits the request to transfer funds to the secondary credit meter to the primary game controller. The flow continues at block 706.

At block 706, the secondary gaming system receives an indication of a funds transfer from the primary game controller. The flow continues at block 708.

At block 708, the secondary gaming system transmits the indication of the funds transfer to the secondary game controller. In some embodiments, the secondary gaming system transmits the indication of the funds transfer to an accounting server for record-keeping purposes.

Figure 8:
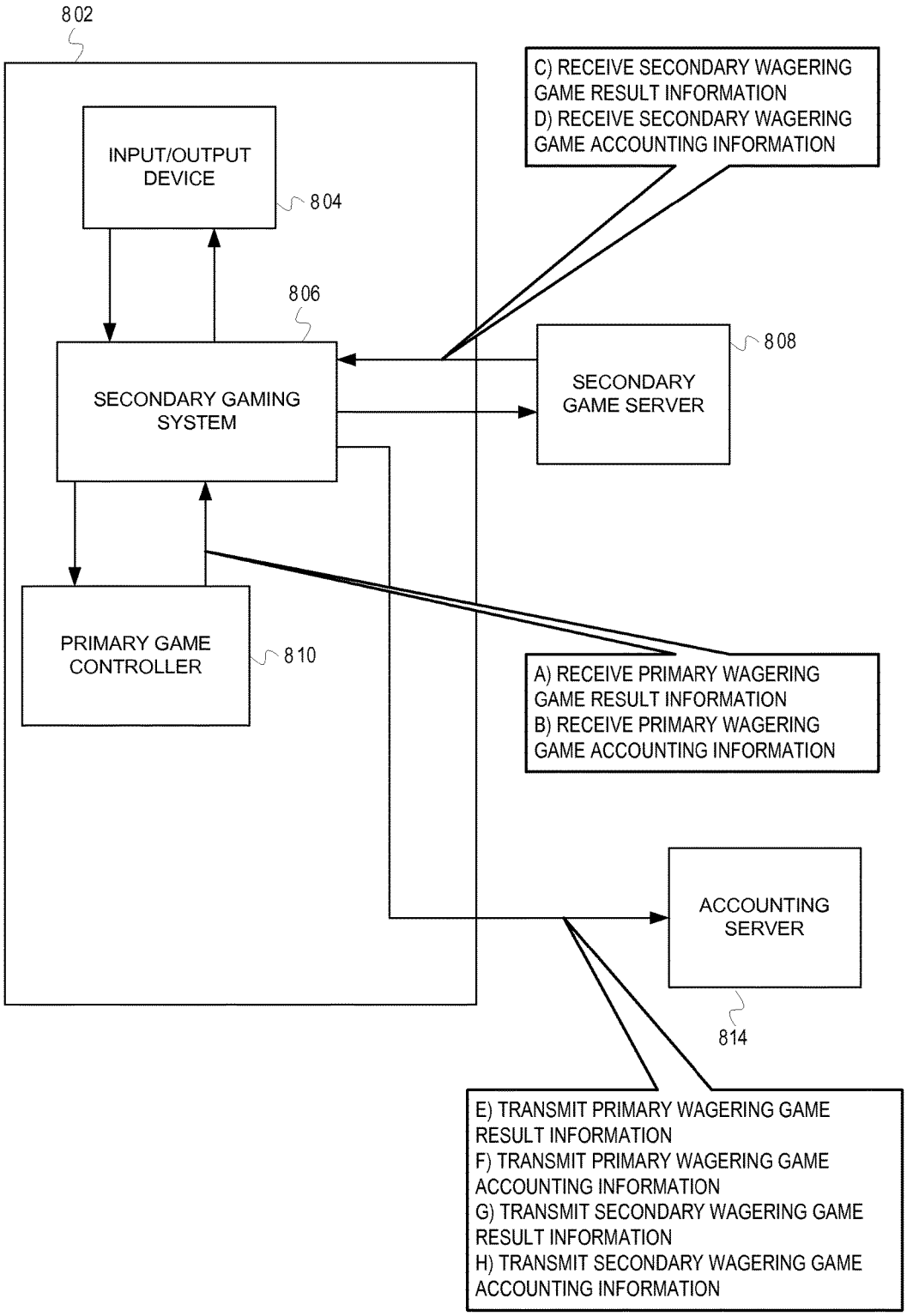
FIG. 8 is a block diagram of an example wagering game system including example operations for reporting wagering game information to an accounting server 814.
Figure 9:
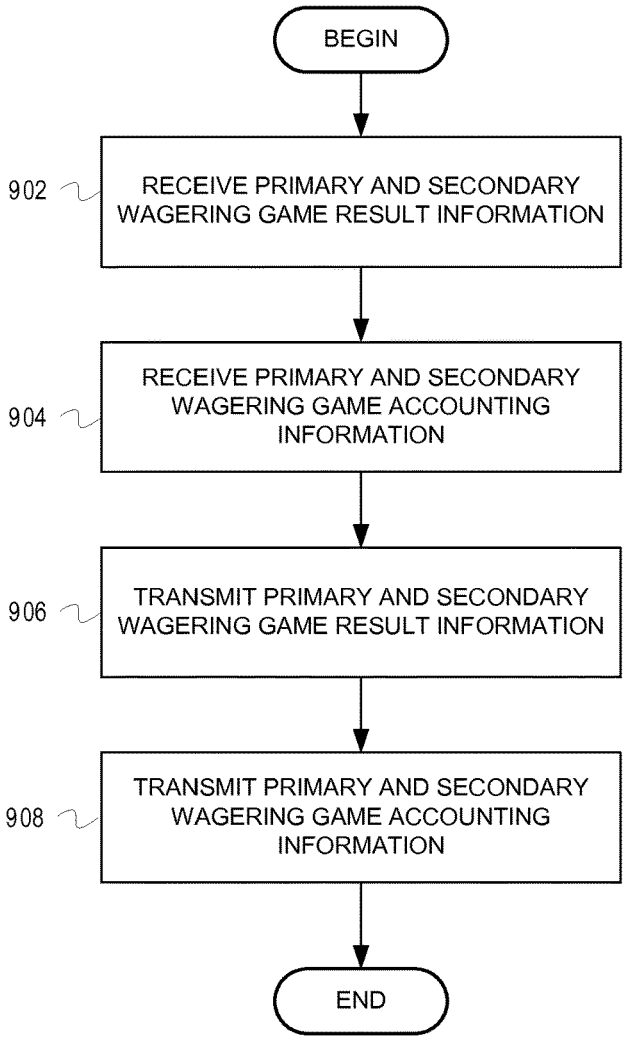
FIG. 9 is a flow diagram illustrating example operations for reporting wagering game system information to an accounting server.

While FIGS. 6 and 7 describe example operations for funding a secondary credit meter, FIGS. 8 and 9 describe reporting of secondary wagering game information to an accounting server.

FIG. 8 is a block diagram of an example wagering game system including example operations for reporting wagering game information to an accounting server 814. The example wagering game system includes a secondary game server 808, an accounting server 814, and a wagering game machine 802 including a secondary gaming system 806 and a primary game controller 810. FIG. 8 depicts example operations at stages A-H. The stages are examples and are not necessarily discrete occurrences over time (e.g., the operations of different stages may overlap).

At stage A, the secondary gaming system 806 receives primary wagering game result information for the primary wagering game from the primary game controller 810. The primary wagering game result information includes an indication of whether the player won or lost a round of the primary wagering game. In some embodiments, the primary wagering game result information includes data generated in determining a result of the round, such as random numbers generated, an indication of a round identification (e.g., a round identification number), a wagering game machine identifier for the wagering game machine 802 on which the wagering game round was played, an identification of the round of the wagering game, etc.

At stage B, the secondary gaming system 806 receives primary wagering game accounting information from the primary game controller 810. The primary wagering game accounting information can include a current balance for the primary credit meter, an amount bet on a round of the primary wagering game, an amount won or lost during the round of the wagering game, a previous balance of the primary credit meter, etc.

At stage C, the secondary gaming system 806 receives secondary wagering game result information for the secondary wagering game from the secondary game server 808. The secondary wagering game result information can include an indication of whether the player won or lost a round of the secondary wagering game. In some embodiments, the secondary wagering game result information includes data generated in determining a result of the round, such as random numbers generated, an indication of a round identification (e.g., a round identification number), a wagering game machine identifier for the wagering game machine 802 on which the wagering game round was played, etc.

At stage D, the secondary gaming system 806 receives secondary wagering game accounting information from the secondary game server 808. The secondary wagering game accounting information can include a current balance for the secondary credit meter, an amount bet on a round of the secondary wagering game, an amount won or lost during the round of the wagering game, a previous balance of the secondary credit meter, etc.

The operations at stages E-H describe transmitting information to the accounting server 814. Although shown in separate transmissions, some embodiments may combine one or more of E-H into fewer transmissions.

At stage E, the secondary gaming system 806 transmits the primary wagering game result information to an accounting server 814. In some embodiments, the secondary gaming system 806 includes dedicated hardware and/or software such as an accounting server message controller (not shown) to communicate with the accounting server 814. In such embodiments, the accounting server message controller transmits the primary wagering game result information to the accounting server.

At stage F, the secondary gaming system 806 transmits the primary wagering game accounting information to the accounting server 814.

At stage G, the secondary gaming system 806 transmits the secondary wagering game result information to an accounting server 814. In some embodiments, the secondary gaming system 806 includes dedicated hardware and/or software such as an accounting server message controller (not shown) to communicate with the accounting server 814. In such embodiments, the accounting server message controller transmits the secondary wagering game result information to the accounting server.

At stage H, the secondary gaming system 806 transmits the secondary wagering game accounting information to the accounting server 814.

In some embodiments, the operations of FIG. 8 (and FIG. 9) can be initiated by the primary game controller 810 or the secondary gaming system 806 (e.g., after every round of the primary and/or secondary wagering game, ever five rounds, every two minutes, etc.). In other embodiments, the accounting server 814 can periodically poll the wagering game machine 802 for accounting information. In such embodiments, the stages depicted in FIG. 8 can be preceded and/or prompted by a request for game result and/or accounting information from the accounting server 814.

FIG. 9 is a flow diagram illustrating example operations for reporting secondary wagering game system information to an accounting server. The flow begins at block 902.

At block 902, the secondary gaming system receives primary and secondary wagering game result information from the secondary game server. The wagering game result information includes an indication of whether the player won or lost a round of the wagering game. In some embodiments, the wagering game result information includes data generated in determining a result of the round, such as random numbers generated, an indication of a round identification (e.g., a round identification number), a wagering game machine identifier for the wagering game machine on which the wagering game round was played, an identification of the round of the wagering game, etc. The flow continues at block 904.

At block 904, the secondary gaming system receives primary and secondary wagering game accounting information from the secondary game controller. The wagering game accounting information can include a current balance for the primary and/or secondary credit meter, an amount bet on a round of the primary and/or secondary wagering game, an amount won or lost during the round of the wagering game, a previous balance of the primary and/or secondary credit meter, etc. The flow continues at block 906.

At block 906, the secondary gaming system transmits the primary and secondary wagering game result information to the accounting server. The flow continues at block 908.

At block 908, the secondary gaming system transmits the primary and secondary wagering game accounting information to the accounting server. In some embodiments, the accounting server is a central repository for primary and secondary wagering game result and accounting information. In such embodiments, the accounting server may receive primary and secondary wagering game result and accounting information from a plurality of gaming systems in one or more wagering game establishments (e.g., casinos).

OPERATING ENVIRONMENT

Although the discussion above describes various embodiments of wagering game machines and secondary gaming systems, this section describes how the wagering game machines can be connected in a network.

Figure 10:
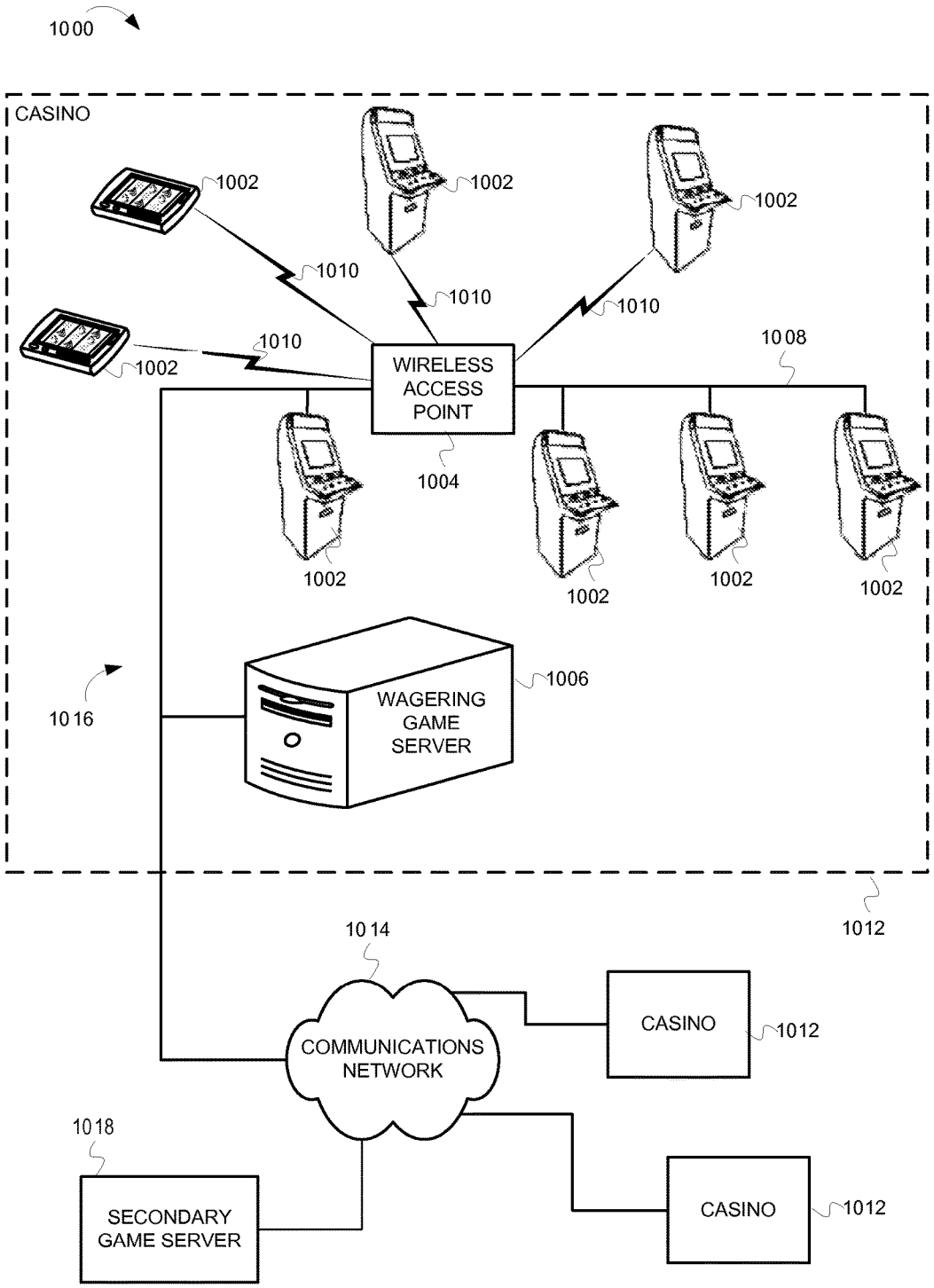
FIG. 10 is a block diagram illustrating a wagering game network 1000, according to example embodiments of the invention.

FIG. 10 is a block diagram illustrating a wagering game network 1000, according to example embodiments of the invention. As shown in FIG. 10, the wagering game network 1000 includes a plurality of casinos 1012 connected to a communications network 1014 and a secondary game server 1018 for providing secondary wagering games connected to the communications network 1014.

Each casino 1012 includes a local area network 1016, which includes an access point 1004, a wagering game server 1006, and wagering game machines 1002. The wagering game machines 1002 can include secondary gaming systems, as described herein to allow for play of primary and secondary wagering games in parallel. The access point 1004 provides wireless communication links 1010 and wired communication links 1008. The wired and wireless communication links can employ any suitable connection technology, such as Bluetooth, 802.11, Ethernet, public switched telephone networks, SONET, etc. In some embodiments, the wagering game server 1006 can serve wagering games and distribute content to devices located in other casinos 1012 or at other locations on the communications network 1014.

The wagering game machines 1002 described herein can take any suitable form, such as floor standing models, handheld mobile units, bartop models, workstation-type console models, etc. Further, the wagering game machines 1002 can be primarily dedicated for use in conducting wagering games, or can include non-dedicated devices, such as mobile phones, personal digital assistants, personal computers, etc. In one embodiment, the wagering game network 1000 can include other network devices, such as accounting servers, wide area progressive servers, player tracking servers, and/or other devices suitable for use in connection with embodiments of the invention.

In some embodiments, wagering game machines 1002 and wagering game servers 1006 work together such that a wagering game machine 1002 can be operated as a thin, thick, or intermediate client. For example, one or more elements of game play may be controlled by the wagering game machine 1002 (client) or the wagering game server 1006 (server). Game play elements can include executable game code, lookup tables, configuration files, game outcome, audio or visual representations of the game, game assets or the like. In a thin-client example, the wagering game server 1006 can perform functions such as determining game outcome or managing assets, while the wagering game machine 1002 can present a graphical representation of such outcome or asset modification to the user (e.g., player). In a thick-client example, the wagering game machines 1002 can determine game outcomes and communicate the outcomes to the wagering game server 1006 for recording or managing a player's account.

In some embodiments, either the wagering game machines 1002 (client) or the wagering game server 1006 can provide functionality that is not directly related to game play. For example, account transactions and account rules may be managed centrally (e.g., by the wagering game server 1006) or locally (e.g., by the wagering game machine 1002). Other functionality not directly related to game play may include power management, presentation of advertising, software or firmware updates, system quality or security checks, etc.

Any of the wagering game network components (e.g., the wagering game machines 1002) can include hardware and computer-readable media including instructions for performing the operations described herein. Any combination of one or more computer readable medium(s) may be utilized. The computer readable medium may be a computer readable signal medium or a computer readable storage medium. Some examples (a non-exhaustive list) of the computer readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

GENERAL

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A method for presenting wagering games on a gaming machine, the gaming machine including a native game controller and an add-on gaming system distinct from the native game controller, the method comprising:

detecting, by the add-on gaming system, a message indicating initiation of a first wagering game native to the gaming machine, the first wagering game being associated with a first credit meter; and in response to the detecting, assessing, by the native game controller and/or by the add-on gaming system, a balance of the first credit meter and a balance of a second credit meter associated with a second wagering game; and in response to the assessing showing an insufficient funds condition for the first credit meter but not for the second credit meter, preventing, by the add-on gaming system, an initiation of the second wagering game.

2. The method of claim 1, wherein the insufficient funds condition triggers prompting a player to add funds to the gaming machine.

3. The method of claim 1, the method further comprising correcting the insufficient funds condition by transferring funds between the first credit meter and the second credit meter.

4. The method of claim 3, wherein transferring the funds includes receiving a funds transfer protocol message requesting a funds transfer from the second credit meter, determining if the second credit meter contains funds sufficient to fulfil the request and, in response to the second credit meter containing sufficient funds, crediting the funds to the first credit meter and debiting the funds from the second credit meter.

5. The method of claim 1, wherein the first credit meter and the second credit meter are independent of each other.

6. The method of claim 1, wherein the second credit meter is controlled by the add-on gaming system.

7. The method of claim 1, wherein the native game controller assesses the balances of the first credit meter and the second credit meter.

8. The method of claim 1, wherein the native game controller assesses the balance of the first credit meter and the add-on gaming system assesses the balance of the second credit meter.

9. The method of claim 1, further comprising, in an absence of an insufficient funds condition, initiating the second wagering game without any additional player input.

10. A secondary gaming device connected for communication between an input device and a primary gaming controller of a wagering gaming machine, the secondary gaming device comprising:

one or more processors; and a memory storage device storing instructions that, when executed by the one or more processors, cause the secondary gaming device to:

intercept a message to the primary gaming controller indicating initiation of a first wagering game native to the gaming machine, the first wagering game being associated with a first credit meter;

in response to detecting the message, assess a balance of the first credit meter and a balance of a second credit meter associated with a second wagering game; and in response to the assessing showing an insufficient funds condition for the first credit meter and not the second credit meter, prevent an initiation of the second wagering game.

11. The secondary gaming device of claim 10, wherein the first credit meter and the second credit meter are independent of each other.

12. The secondary gaming device of claim 10, wherein the second credit meter is controlled by the secondary gaming device.

13. The secondary gaming device of claim 10, wherein a result for the first wagering game is determined by the primary gaming controller and a result for the second wagering game is determined by the secondary gaming device.

14. The secondary gaming device of claim 10, wherein the instructions further cause the secondary gaming device to arrange the first wagering game and the second wagering game, when initiated, to appear in parallel on a display device of the gaming machine.

15. The secondary gaming device of claim 10, further comprising a communication interface connected to a secondary game server.

16. The secondary gaming device of claim 15, wherein the secondary wagering game includes content provided by the secondary game server.

17. The secondary gaming device of claim 15, wherein a result for the second wagering game is provided to the secondary gaming device by the secondary game server.

18. A secondary gaming system connected for communication between an input device and a primary gaming controller of a gaming machine, the secondary gaming system comprising:

one or more processors;

a communication interface connecting the one or more processes processors to a secondary game server;

a memory storage device storing instructions that, when executed by the one or more processors, cause the secondary gaming system to:

intercept a message to the primary gaming controller indicating initiation of a first wagering game native to the gaming machine, the first wagering game being associated with a first credit meter;

in response to detecting the message, assess a balance of the first credit meter and a balance of a second credit meter associated with a second wagering game that includes content from the secondary gaming server; and in response to the assessing showing an insufficient funds condition for the first credit meter and not for the second credit meter, prevent an initiation of the second wagering game.

19. The secondary gaming system of claim 18, wherein the instructions further cause the secondary gaming system to transmit first wagering game accounting information and/or second wagering game accounting information to an external accounting server.

20. The secondary gaming system of claim 19, wherein accounting information includes one or more of a current balance of a respective credit meter, credits wagered on a respective wagering game, or a previous balance of a respective credit meter.

* * * * *